US006083124A

United States Patent [19]

Williams

[11] Patent Number: 6,083,124

[45] Date of Patent: Jul. 4, 2000

[54] PORTABLE COLLAPSIBLE BACKSTOP FOR BATTING PRACTICE

[76] Inventor: Robert R. Williams, 6601 Harbor Town #1818, Houston, Tex. 77036

[21] Appl. No.: 09/220,645

[22] Filed: Dec. 24, 1998

[51] Int. Cl.[7] ..... A63B 67/00; A63B 57/00; A63B 63/00

[52] U.S. Cl. ..... 473/421; 473/197; 273/400

[58] Field of Search ..... 473/417, 421, 473/454, 197, 431–451; 273/400

[56] References Cited

U.S. PATENT DOCUMENTS

| | | | |
|---|---|---|---|
| 4,083,559 | 4/1978 | Owen, Jr. | 473/197 |
| 4,489,941 | 12/1984 | Shieh | 473/197 |
| 4,723,780 | 2/1988 | Vinzetta | 473/197 |
| 4,905,996 | 3/1990 | Tallent et al. | 473/454 |
| 5,242,160 | 9/1993 | Girard et al. | 473/454 |
| 5,333,856 | 8/1994 | Gery | 473/454 |
| 5,342,063 | 8/1994 | O'Brien et al. | 473/197 |
| 5,482,269 | 1/1996 | Scott et al. | 473/197 |
| 5,564,711 | 10/1996 | Scheie | 273/400 |
| 5,573,240 | 11/1996 | Humboldt | 473/454 |
| 5,690,339 | 11/1997 | Chen | 473/197 |
| 5,839,733 | 11/1998 | Meeks et al. | 273/400 |

*Primary Examiner*—Jeanette Chapman
*Attorney, Agent, or Firm*—Kenneth L Tolar

[57] ABSTRACT

A collapsible, lightweight backstop includes a U-shaped base member having parallel arms and a rear portion therebetween. The arms include separable mating sections that are hingedly joined to a vertical support leg whereby the arm sections may be folded and collapsed thereagainst. An upper frame member is pivotally joined to the upper ends of the support legs and may be moved between raised and lowered vertical positions. A net member is secured to the base member, the legs and the upper frame member to form a backstop including a ball retaining pocket. A telescoping tubular frame member is pivotally joined to the upper end of each support leg. An auxiliary net is secured to the frame member and the support leg to form a lateral extension when the frame member is pivoted outwardly to an oblique position. The base member and frame members each include apertures for receiving a stake or similar means to anchor the device to the ground.

8 Claims, 2 Drawing Sheets

PORTABLE COLLAPSIBLE BACKSTOP FOR BATTING PRACTICE

BACKGROUND OF THE INVENTION

The present invention relates to a lightweight collapsible backstop designed to protect a pitcher from being struck by a ball when pitching batting practice.

DESCRIPTION OF THE PRIOR ART

Baseball and softball injuries often occur during batting practice since the pitcher throws numerous pitches with less effort than would be exerted during a game. Accordingly, a batting practice pitcher often stands behind a protective net or backstop assembly to protect the pitcher from sharply hit balls.

Conventional devices for protecting a batting practice pitcher are bulky, heavy, and therefore, cumbersome to disassemble and transport. The present invention provides a uniquely designed, portable backstop which can be compactly folded for transport or storage.

Various backstops and similar devices exist in the prior art. For example, U.S. Pat. No. 5,573,240 issued Humboldt relates to a baseball backstop for pitching practice comprising a frame having a netting attached thereto. The netting has a relatively heavy, deformable piece of material thereon that, when struck by a ball, a popping or thumping noise is emitted indicating that the thrown ball is a strike.

U.S. Pat. No. 5,342,063 issued to O'Brien et al relates to a ball game apparatus including a plurality of interengaging rigid sections which form a rectangular outline having an arcuate ball retaining surface. A plurality of rods engage and project outwardly from a respective section.

U.S. Pat. No. 5,333,856 issued to Gery relates to a pitching practice apparatus including a backstop member stretched between a substantially rectangular frame member. A strike zone member is placed on the backstop member forming a pouch that may be stretched by an auxiliary tensioning unit.

U.S. Pat. No. 5,242,160 issued to Girard et al relates to a portable backstop having a vertically upstanding inverted U-shaped frame supported on a base and a smaller U-shaped frame pivotally connected to an intermediate point of the inverted U-shaped frame. The vertical frame supports a mesh net for receiving a ball. The smaller U-shaped frame may be extended outward from the net to form a pocket for receiving a ball.

U.S. Pat. No. 4,489,941 issued to Shieh relates to a sports net apparatus including inner frame members, a substantially rectangular outer frame and a netting material. The inner frame member is characterized by at least two adjusting rods, each being attached by a spring element in spaced relationship to a side of the netting material and substantially perpendicular to each other. The outer frame is attached by spring elements to at least two perpendicular sides of the netting material. Adjustable screws attach each adjusting rod to the outer frame whereby adjustment of the screws results in varying tension of the netting material.

U.S. Pat. No. 4,083,559 issued to Owen, Jr. relates to a sports training apparatus employing a mirror that permits the player to view body movements while using the mirror as a target.

Although various backstops exist in the prior art, none relate to a portable lightweight backstop according to the present invention. The present invention also includes collapsible, lateral extensions which may be expanded to increase the width of the device. Furthermore, the various structural components may be conveniently collapsed for transport and storage.

SUMMARY OF THE INVENTION

The present invention relates to a lightweight, portable backstop which may be compactly folded for transport and storage. The device comprises a substantially horizontal U-shaped base member including two opposing parallel arms and a rear portion therebetween. Each arm is comprised of two sections which are hingedly joined to a vertical, telescoping support leg. The arm sections and rear portion of the base member include one or more apertures for receiving a stake member to anchor the base member to the ground. A rectangular, upper frame member is pivotally attached to the top ends of the support legs and may be swivelled between a vertical collapsed position, adjacent the support legs, and a raised vertical position superimposed thereon. Pivotally joined to the outwardly facing side of each support leg, adjacent its top end, is a telescoping tubular frame member having an aperture at its lower distal end for receiving an anchoring member to secure the frame member to the ground. A substantially triangular net member is attached to each frame member and the adjoining support leg to form a lateral extension when the frame member is pivoted outwardly to an oblique position. When the device is not in use, the various components may be pivoted and collapsed allowing the entire backstop assembly to be conveniently stored or transported. It is therefore an object of the present invention to provide a portable backstop which may be compactly folded for transport and storage.

It is yet another object of the present invention to provide a backstop assembly having lateral extensions for selectively increasing the width of the device.

It is yet another object of the present invention to provide a backstop assembly having a pivotable top portion to selectively increase the height thereof. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
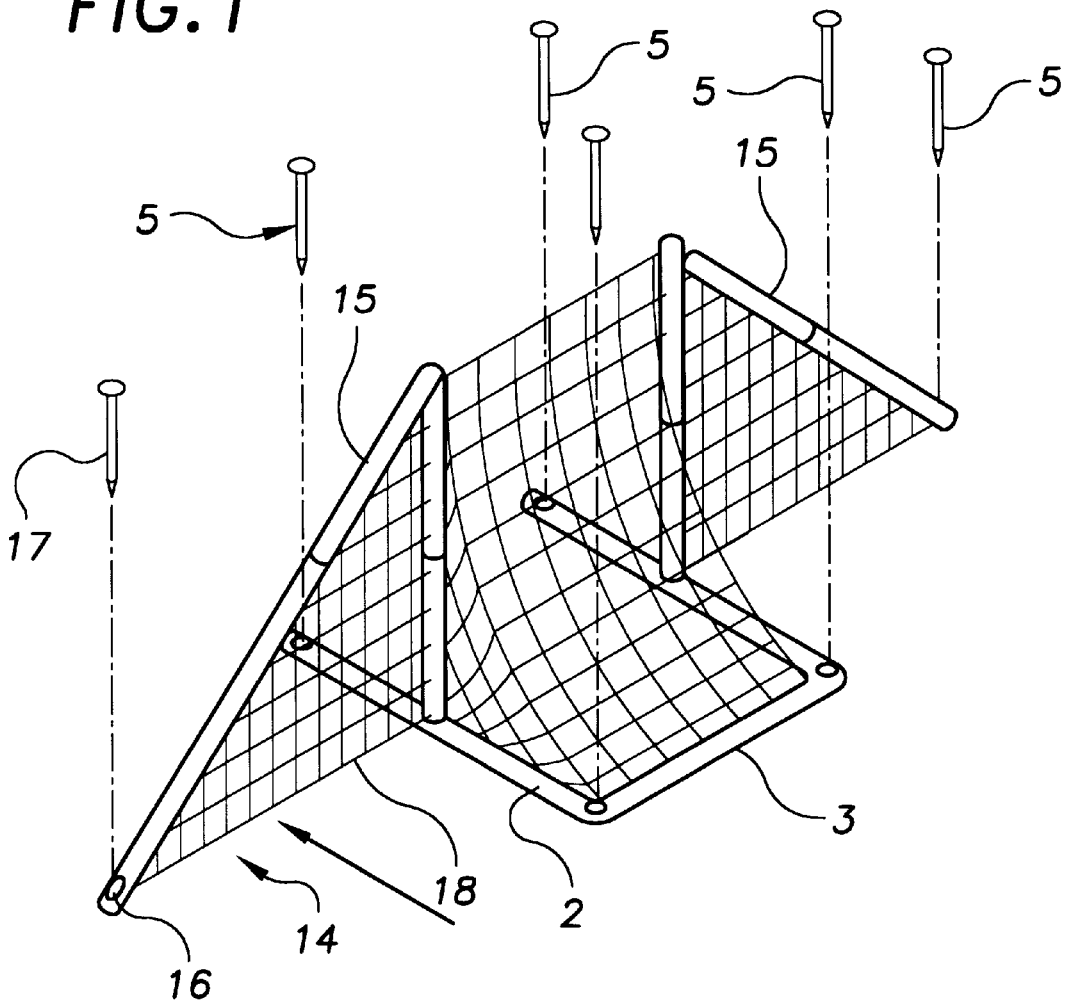
FIG. 1 depicts the inventive device with the lateral extensions in an expanded position.
Figure 2:
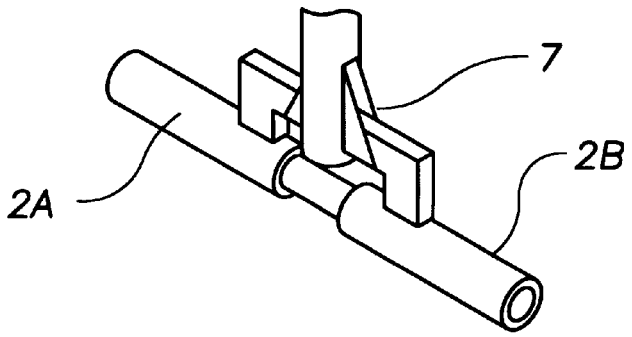
FIG. 2 is a detail of the hinge assembly interconnecting the base member sections and the support legs.

Referring now to FIGS. 1 through 5, the present invention relates to a portable, collapsible backstop assembly. The device comprises a horizontally disposed, substantially U-shaped base member 1 including a pair of parallel tubular arms 2 with a rear tubular portion 3 therebetween. Each tubular arm is comprised of front 2A and rear 2B mating, separable sections, one of which includes a protrusion 10 at an end thereof for engaging a receptacle 11 at an end of the mating section. The arm sections and rear portion each include one or more apertures 4 for receiving stake 5 or similar anchor members to secure the base member to the ground.

Each mating end of the arm sections is hingedly attached to a vertical telescoping support leg 6. The hinge assembly 7 preferably allows each section to be moved a slight distance away from the mating section so that the protrusion may be removed from its mating receptacle prior to pivoting the sections. Accordingly, each arm section may be collapsed against a side of a corresponding leg allowing the device to be compactly stored.

Figure 3:
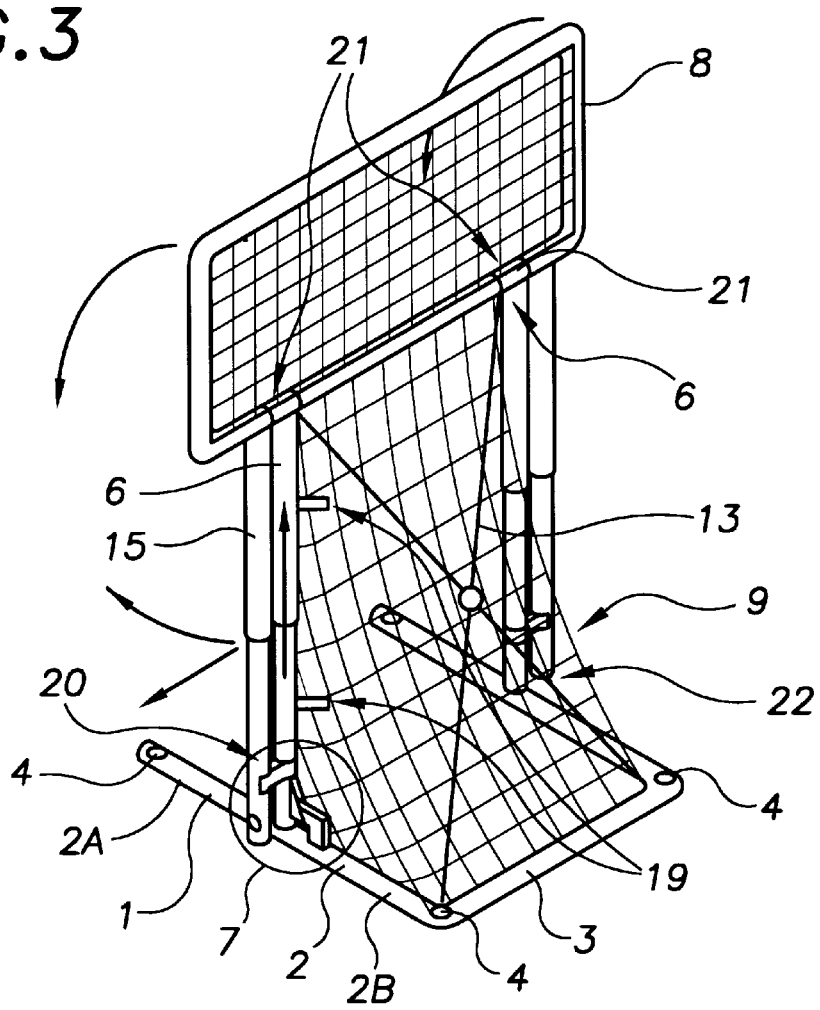
FIG. 3 is a perspective view of the inventive device.
Figure 4:
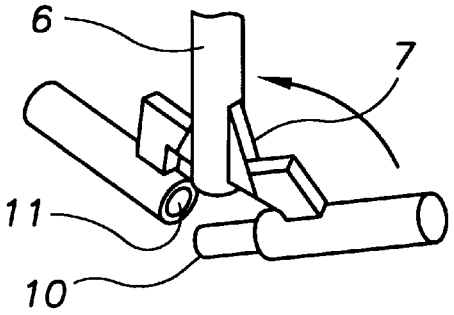
FIG. 4 depicts the mating sections of the base member.
Figure 5:
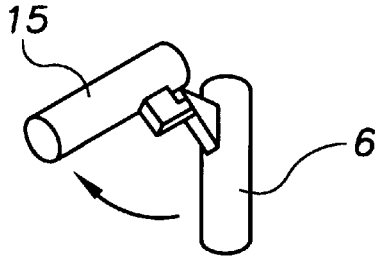
FIG. 5 depicts a hinge assembly for the lateral extensions.

A substantially rectangular frame member 8, having upper, lower and two opposing sides, is pivotally joined to the top ends of the support legs with a swivel joint 21 or similar means. The frame member may be pivoted between a first vertical, lower position, resting against the telescoping support legs, and a second, vertical raised position wherein the frame member is superimposed thereon as depicted in FIG. 3. Preferably, a locking means (not pictured) is also included for fixing the upper frame member in the raised position. Such a locking means may include straps, cords, clips, brackets, braces, bolts, screws or any other similar conventional means.

A net member 9 is secured to the base member rear portion, the rear arm sections, the vertical support legs and each of the four sides of the upper frame member. The net member is configured to form a ball retaining pocket 22 below the upper frame member. Alternatively, upper and lower net members may be provided with the lower net attached to the base member and to the support legs. The upper net is secured between the four sides of the upper frame. In either embodiment, the net is secured using conventional means.

Attached to the rear surface of the ball retaining pocket, at a substantially central portion thereof, is one or more stretchable cords 13 such as those commonly known as a Bungee™ cords. An upper end of each cord is secured to the lower side of the upper frame component and the opposing end is attached to the rear portion of the base member for providing structural integrity to the backstop. Alternatively, upper and lower ends of each cord may be secured to the upper and lower portions of the net member, respectively.

The device also includes a pair of lateral extensions 14 for extending the width of the backstop, if needed. The extensions each include a telescoping tubular frame member 15 having an upper and lower end. The upper end of each frame member is hingedly joined to the upper end of a telescoping support leg. The frame member is pivotable between a vertical, collapsed position, immediately adjacent the adjoining support legs, and an oblique position, extending outwardly therefrom. The lower end includes an aperture 16 for receiving a stake member 17 or similar anchoring means to secure the frame member to the ground when in an extended and oblique position. A substantially triangular auxiliary net member 18 has a first edge attached to the frame member and a second edge attached to the telescoping support leg. Accordingly, the width of the backstop may be increased by pivoting either or both of the frame members outwardly away from the vertical legs to an oblique position until the triangular net is taut. The frame members are extended until their lower ends are adjacent the ground and the frame members are anchored thereto.

The vertical support legs preferably each include one or more straps 19 having a hook and loop fastener or similar fastener means thereon for wrapping about the extension frame members when the frame members are collapsed thereagainst. Each leg may also include a clip 20 member for further securing the frame members in the collapsed position. Each of the telescoping frame members and telescoping vertical legs also preferably include a locking means for locking each of the telescoping components in an extended or retracted position. Such locking means may include, but is not limited to, a pin removably insertable into aligned apertures on the telescoping sections or a spring biased pin on each section that is received within an aperture on the adjacent section. Any similar conventional means for locking telescoping sections may also be used.

The U-shaped base, telescoping legs, extension frame members and upper frame member may be constructed from PVC pipe, ABS plastic or similar lightweight equivalent allowing the device to be easily transported. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible backstop assembly comprising:

a substantially U-shaped horizontal base member including a pair of parallel arms with a rear portion therebetween, each of said arms formed of front and rear detachable mating sections;

a telescoping support leg vertically extending from each arm and hingedly joined to each mating front and rear arm sections, said legs terminating at an upper end whereby said arm sections can be pivoted between a parallel, juxtaposed position and a perpendicular position relative to said leg;

a substantially rectangular upper frame member pivotally joined to the upper ends of said support legs, said frame member pivotable between a lowered vertical position and a raised vertical position;

a net member attached to the rear portion and rear arm sections of said support member, to said vertical legs, and peripherally bordered by said upper frame member whereby said front and rear arm sections are pivoted vertically and collapsed against said support legs and said upper frame member is pivoted to the lower vertical position to transport and store said backstop assembly.

2. A device according to claim 1 further comprising a lateral extension assembly expandable from and collapsible against each leg for selectively extending the width of the backstop assembly.

3. A device according to claim 2 wherein each lateral extension assembly comprises:

a telescoping, tubular member having an upper and lower end with the upper end pivotally joined to the upper end of one of said legs, said tubular member pivotable between a vertical collapsed position, immediately juxtaposed said support leg, and an oblique position extending outwardly therefrom;

an auxiliary net member attached to said frame member and said leg that expands to form a barrier when said frame member is pivoted to the oblique position.

4. A device according to claim 3 wherein said telescoping tubular member further includes an aperture adjacent the lower end for receiving an anchoring means to secure the tubular member to the ground.

5. A device according to claim 4 wherein said base member includes a plurality of apertures for receiving an anchoring means to secure the base member to the ground.

6. A device according to claim 5 further comprising a plurality of stretchable cords extending along said net member to provide resiliency thereto and to provide structural integrity to said backstop assembly.

7. A device according to claim 6 wherein said support legs each include a strap secured thereto, said strap having a fastener means thereon for encompassing and securing said frame member.

8. A device according to claim 7 wherein said support legs each include a clip member for receiving one of said tubular members to retain said tubular member in the vertical collapsed position.

* * * * *